United States Patent [19]

Okumoto et al.

[11] Patent Number: 5,009,425

[45] Date of Patent: Apr. 23, 1991

[54] GOLF CLUB HEAD

[75] Inventors: Takaharu Okumoto, Chigasaki; Toshio Ninomiya, Isehara; Tstsuya Hayashi, Hiratsuka, all of Japan

[73] Assignee: The Yokohama Rubber Co., Ltd., Tokyo, Japan

[21] Appl. No.: 427,539

[22] Filed: Oct. 27, 1989

[30] Foreign Application Priority Data

Oct. 27, 1988 [JP] Japan ..... 63-269494
Aug. 28, 1989 [JP] Japan ..... 1-218519

[51] Int. Cl.[5] ..... A63B 53/04

[52] U.S. Cl. ..... 273/167 R; 273/DIG. 5; 273/DIG. 12; 273/167 H; 273/169; 273/DIG. 23

[58] Field of Search ..... 273/DIG. 7, DIG. 23, 273/167 H, 169, 171-173, 167 J, 167 R, DIG. 5, DIG. 12; 264/259, 255, 241, 271.1, 328.18, 297.2; 428/308.4, 318.4

[56] References Cited

U.S. PATENT DOCUMENTS

| | | | |
|---|---|---|---|
| 4,650,193 | 3/1987 | Molitor et al. | 273/228 |
| 4,667,963 | 5/1987 | Yoneyama | 273/169 |
| 4,793,616 | 12/1988 | Fernandez | 273/167 H |
| 4,803,023 | 2/1989 | Enomoto et al. | 273/167 H X |
| 4,824,116 | 4/1989 | Nagamoto et al. | 273/171 |
| 4,839,116 | 6/1989 | Puckett et al. | 273/60 B X |
| 4,874,171 | 10/1989 | Ezaki et al. | 273/167 H X |

OTHER PUBLICATIONS

Askeland, Donald R. "The Science and Engineering of Materials", Copyright 1984 by wadsworth, Inc. pp. 455-502.

*Primary Examiner*—Edward M. Coven
*Assistant Examiner*—Sebastiano Passaniti
*Attorney, Agent, or Firm*—Finnegan, Henderson, Farabow, Garrett & Dunner

[57] ABSTRACT

A golf club head in which a core buried in the interior of an outer shell of a fiber reinforced resin is molded out of a molten mixture of a thermoplastic resin and powder of a metal having a high specific gravity, and a method of manufacturing such golf club heads.

4 Claims, 2 Drawing Sheets

GOLF CLUB HEAD

BACKGROUND OF THE INVENTION

This invention relates to a golf club head and a method of manufacturing the same, and more particularly, to a golf club head having a core which is buried therein and can be obtained with an imroved processability, and which enables the weight of the club head to be regulated easily, and a method of manufacturing the same.

In general, a golf club head having a club head body molded out of a fiber-reinforced resin has a weight regulating core buried in the club head body. This core is an important constituent element used for controlling the driving performance of the golf club by varying the shape, weight and position of the center of gravity thereof. A conventional core of this kind consists of a molded body composed of a mixture of a resin and a suitable quantity of powder of a metal having a high specific gravity, and the driving performance of a golf club containing such a core is controlled by regulating the shape of the molded body and a mixing quantity and distribution of the metal powder.

A conventional core of a golf club head consists as disclosed in Japanese utility model application Kokai publication No. 61-154968 of a thermosetting resin which is identical with an epoxy resin constituting an outer shell of the club head body. This thermosetting resin has excellent mechanical properties but it has a low moldability. Therefore, it is very difficult to mold a thermosetting resin to a complicted shape. Accordingly, molding such a core out of a thermosetting resin to a desired shape and regulating the weight thereof to a desired level are attended by much difficulty and cause an increase in the manufacturing cost. As disclosed in Japanese patent application Kokai publication No. 62-144675, a core consisting of a foamed resin into which heavy metal powder is dispersed has also been proposed. However, since this core employs a foamed resin as a main material, it is difficult to disperse the heavy metal powder to arbitrary positions therein, and the metal powder is apt to be displaced when a ball is hit by the golf club. Thus, this core gives rise to problems with the stability of the performance of the golf club.

SUMMARY OF THE INVENTION

An object of the present invention is to provide a golf club head containing a core which is capable of being molded easily out of a mixture of powder of a metal having a high specific gravity, and which permits easy regulation of the weight and center of gravity thereof.

Another object of the present invention is to provide a golf club head containing a core which is not readily deformed even when a ball is hit repeatedly by the golf club, and which is capable of preventing the initial performance of the golf club from varying.

Still another object of the present invention is to provide a method of manufacturing such a golf club head easily by injection molding. easily by injection molding.

To achieve these objects, the present invention provides a golf club head consisting of an outer shell composed of a fiber-reinforced thermosetting resin, a metal sole provided on the lower surface of the outer shell, and a core placed on the upper surface of the sole and buried in the interior of the outer shell, the core being molded out of a mixture of a thermoplastic resin and powder of a metal having a high specific gravity.

The present invention also provides a method of manufacturing golf club heads, consisting of the steps of injection molding a mixed molten material composed of a thermoplastic resin and powder of a metal of a high specific gravity to obtain a core, placing this core on a metal sole, and covering the circumferential surface of the core with a fiber-reinforced thermosetting resin to form an integral outer shell, whereby the sole, core and outer shell are unitarily combined.

Since the thermoplastic resin used for the core is melted easily with heat, it can be injection molded easily even to a complicated shape. Furthermore, the thermoplastic resin in a molten state permits the powder of a metal of a high specific gravity to be dispersed excellently thereinto. Accordingly, the processability of the thermoplastic resin concerning the production of the core is high, so that the weight and the position of the center of gravity of the core can be regulated easily. This enables the weight and the position of the center of gravity of the golf club head to be easily regulated.

The thermoplastic resins out of which the core used in the present invention can be molded include, for example, polyamide, polybutylene terephthalate, polypropylene, ABS and hard vinyl chloride alcohol but these resins may not necessarily be used.

The metal of a high specific gravity which can be mixed in the thermoplastic resins for regulating the weight of the resultant core include, for example, zinc, lead and tugsten but those metals may not necessarily be used; any metal having a high specific gravity may be used.

The fibrous reinforcement material, such as short glass fibers, short carbon fibers and whiskers can be mixed as necessary with a mixture of a thermoplastic resin and powder of a metal of a high specific gravity. Mixing such a fibrous material with this mixture enables the impact resistance of the resultant core to be improved.

In order to form an outer shell, any of the known fiber-reinforced resins may be used. These resins include thermosetting resins, such as an epoxy resin and an unsaturated polyester resin. The fibers preferably used to reinforce this thermosetting resin include fibers having a high strength and a high elastic modulus, such as carbon fibers, glass fibers and aromatic polyamide fibers. In order to mold an outer shell out of a mixture of such a thermosetting resin and such reinforcement fibers, the mixture may preferably be used in the form of prepreg consisting of reinforcement fibers impregnated with an unhardened thermosetting resin, or a sheet molding compound consisting of a reinforcement fiber sheet impregnated with an unhardened thermosetting resin.

The metal out of which a sole is formed may consist of any of the known metals. It preferably consists of a corrosion and abrasion resisting metal, such as stainless steel.

DESCRIPTION OF THE PREFERRED EMBODIMENTS

Figure 1:
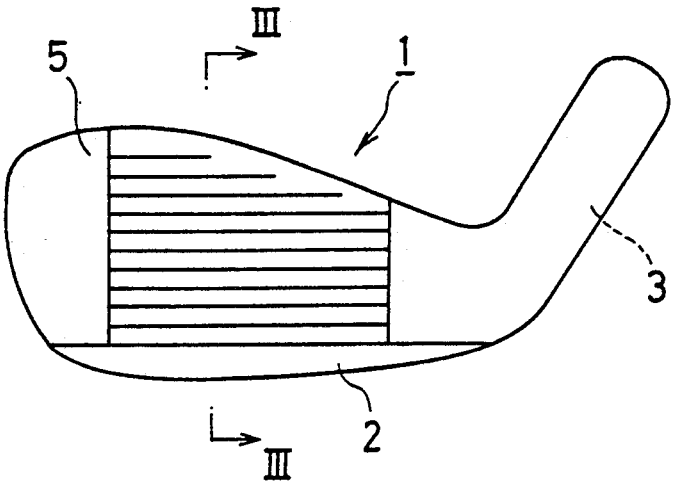
FIG. 1 is a front elevation of an iron golf club head constituting an embodiment of the present invention.
Figure 2:
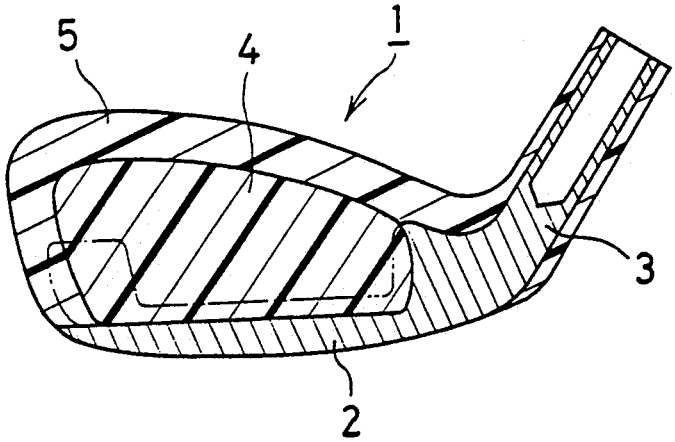
FIG. 2 is a sectional view of the iron golf club head taken along the line II—II with arrows in FIG. 3, in combination with a sectional view of a hosel.
Figure 3:
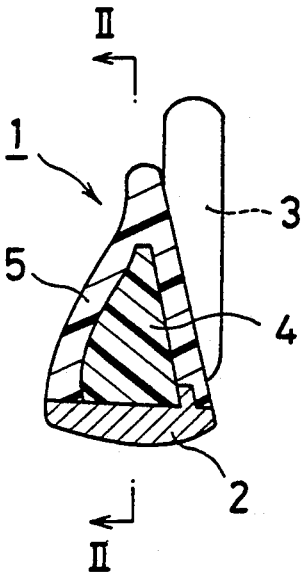
FIG. 3 is a sectional view of the iron golf club head taken along the line III—III with arrows in FIG. 1.

FIGS. 1 to 3 show an embodiment in which the present invention is applied to an iron golf club head.

Referring to the drawings, a metal sole 2 is provided in the lower portion of a club head body 1. This sole 2 is molded out of a metal integrally with a hosel 3 which constitutes a portion to which a shaft (not shown) is connected. A core 4 is placed on the upper surface of the sole 2, and enclosed with an outer shell 5 consisting of a fiber reinforced resin, to combine these parts unitarily with one another. The fiber reinforced resin constituting the outer shell 5 consists of a thermosetting resin, such as an epoxy resin, and reinforcing fibers, such as carbon fibers.

The core 4 buried in the club head 1 consists of a molded body in which the powder of a metal having a high specific gravity is mixed in a dispersed state in a thermoplastic resin used as a matrix. The weight and the position of the center of gravity of the core 4 can be varied arbitrarily by controlling the shape of the core and the mixing quantity and dispersed condition of the metal of a high specific gravity. Since the core 4 consists mainly of a thermoplastic resin, it is easily injection molded by melting the resin. Accordingly, the core 4 can be molded simply to a desired shap, even to a complicated shape. This enables the weight and the position of the center of gravity of the core 4 to be regulated very easily.

It is preferable that a short fibrous reinforcement material in addition to the powder of a metal of a high specific gravity be mixed in the thermoplastic resin constituting the core 4 because such a fibrous reinforcement material enables the impact resistance of the resultant core to be increased. The specific gravity of a weight-regulated core to be inserted in an iron golf club head should be in the range of 2.0 to 7.0, and the surface hardness thereof in the range of 100 to 130 in terms of Rockwell hardness (ASTMD-785).

Figure 4:
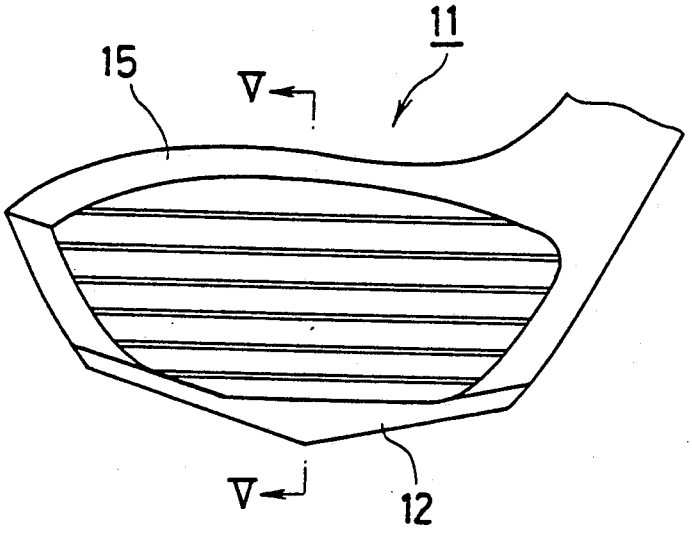
FIG. 4 is a front elevation of a wooden golf club head constituting another embodiment of the present invention.
Figure 5:
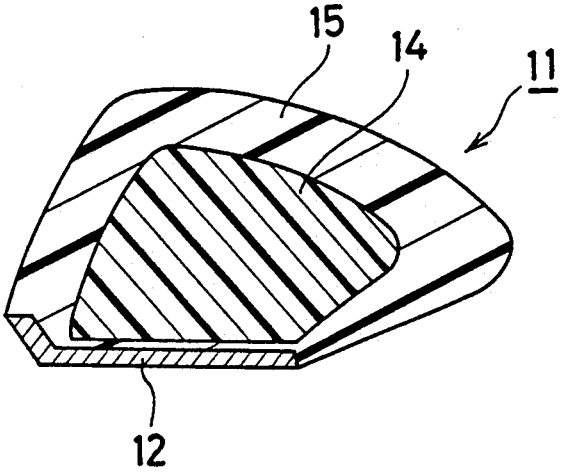
FIG. 5 is a sectional view of the wooden golf club head taken along the line V—V with arrows in FIG. 4.

FIGS. 4 and 5 show an embodiment in which the present invention is aplied to a wooden golf club head.

Referring to the drawings, a club head body 11 is provided with a sole 12 at the lower side portion thereof. A core 14 is placed on this sole 12, and then enclosed with an outer shell 15 consisting of a fiber-reinforced resin, whereby the sole 12, core 14 and outer shell 15 are unitarily combined. The sole 12, core 14 and outer shell 15 in this wooden golf club head are somewhat different only in shape from those in the above-mentioned iron golf club head, and these parts of a wooden golf club head consist of substantially the same materials as those of the sole 2, core 4 and outer shell 5 of an iron golf club head.

In the case of this wooden club head, the specific gravity of the core 14 is preferably set to a level in the range of 1.5 to 5.0, and the surface hardness thereof to a level in the range of 80 to 130 in terms of Rockwell hardness (ASTMD-785).

In order to manufacture the sole and outer shell in the above-described golf club head according to the present invention, the known methods may be used. For example, a sole obtained by casting or forging a metal, or cutting metal block can be used. The outer shell may be formed by placing a prepreg of a fibrous reinforcement material impregnated with an unhardened thermosetting resin, or a sheet molding compound consisting of reinforceing fiber sheet impregnated with an unhardened thermosetting resin on a sole and a core, inserting the resultant product in a metal mold, and then heating the metal mold.

The core used in the present invention can be formed by subjecting a molten mixture of a thermoplastic resin and powder of a metal having a high specific gravity to injection molding using a metal mold. The mixing of the powder of a metal having a high specific gravity with a thermoplastic resin may be done by a method of agitation-mixing such powder directly in a molten thermoplastic resin, or a method of preparing pellets of a thermoplastic resin alone, mixing the metal powder in a solid state with the pellets, and agitation-mixing this solid-state mixture while melting the same. It is recommended that the mixing of such metal powder be done after it has been surface-treated with a surfactant so as to improve the wettability thereof with respect to the thermoplastic resin. If the surface of the particles of the metal powder are thus subjected to an activity-improving treatment, the metal powder can be dispersed uniformly at a high compounding ratio into a thermoplastic resin, so that the durability of the core can be further improved. No particular limitation applies to the surfactant for the surface-treating of the above-mentioned metal powder according to the present invention.

The core thus molded is placed on a sole as mentioned above, and a prepreg or a sheet molding compound mentioned above is then placed on the core. The resultant product is inserted into a metal mold, which is then heated to obtain a golf club head. The golf club head thus molded has an excellent outer shape, and the core inside thereof is hardly deformed by heat. Since the powder of a metal having a high specific gravity is dispersed uniformly in the core, the repeated ball hitting actions do not deform the core. Since the core has a high durability, it enables the performance of the original golf club to be maintained for a long period of time.

EXAMPLE 1

The lead powder as a weight regulating material which had been surface treated with a surface active agent and a small quantity of short glass fibers as an impact resistance improving material were mixed with pellets of a nylon-6 resin, and the resultant mixture was melted and extruded by an injection molding machine to form a plurality of cores having specific gravity of 2.8 and a surface hardness of 116 in terms of Rockwell hardness (ASTM D-785).

These cores were placed on the upper surfaces of cast hosel-carrying soles and fixed thereto with a bonding agent. An unhardened epoxy resin-impregnated carbon fiber prepreg and a sheet molding compound of carbon fibers were then placed on each of these sole-fixed cores, and the resultant product was inserted into a metal mold and molded with heat by a compression molding machine. A plurality of iron golf club heads were thus manufactured.

All of the iron golf club heads had excellent external appearance. The club head bodies were cut, and the cross sections were examined to ascertain that the cores had not substantially been deformed during the thermal molding operations, and that the metal powder was distributed uniformly throughout the cross sections.

A shaft was joined to one of these iron golf club heads to obtain an iron golf club, and a ball was driven thereby for trial to test the durability of the golf club. The feeling of the golf club during the practical use thereof stood comparison with that of a conventional iron golf club. After the iron golf club having a club head obtained in this Example had been subjected to the ball driving test, the club head body was cut, and the cross section thereof was examined to ascertain that the club head was not deformed and broken.

EXAMPLE 2

The lead powder, the mixing quantity of which was increased as compared with that of the lead powder used in Example 1, was used to mold a core having specific gravity of 2.7 and a surface hardness of 117 in terms of Rockwell hardness. The same manufacturing steps as stated above were carried out by using this core to obtain an iron golf club head.

The iron golf club head thus obtained had an excellent external appearance and the same excellent performance as the iron golf club head obtained in Example 1.

EXAMPLE 3

The lead powder as a weight regulating material which had been surface treated with a surface active agent and a small quantity of short glass fibers as an impact resistance improving metarial were mixed with pellets of a polybutylene terephthalate resin, and the resultant mixture was melted and extruded by an injection molding machine to obtain a core having specific gravity of 2.7 and a surface hardness of 117 in terms of Rockwell hardness.

The same manufacturing steps as in Example 1 were carried out by using this core, to obtain an rion golf club head.

The iron golf club head thus obtained that an excellent external appearance and the same excellent performance as the iron golf club head obtained in Example 1.

EXAMPLE 4

The zinc powder as a weight regulating material which had been surface treated with a surface active agent and a small quantity of short glass fibers as an impact resistance improving meterial were mixed with pellets of a nylon-6 resin, and the resultant mixture was melted and extruded by an injection molding machine to obtain a core having specific garvity of 2.2. and a surface hardness of 115 in terms of Rockwell hardness.

The same manufacturing steps as in Example 1 were carried out by using this core, to obtain a wooden golf club head.

The wooden golf club head thus obtained had an excellent external appearance and the same excellent performance as the iron golf club head obtained in Example 1.

EXAMPLE 5

The zinc powder as a weight regulating material which had been surface treated with a surface active agent and a small quantity of short glass fibers as an impact resistance improving material were mixed with pellets of a polybutylene terephthalate resin, and the resultant mixture was melted and extruded by an injection molding machine to obtain a core having specific gravity of 3.4 and a surface hardness of 120 in terms of Rockwell hardness.

The same manufacturing steps as in Example 1 were carried out by using this core, to obtain a wooden golf club head.

The wooden golf club head thus obtained had an excellent external appearance and the same excellent performance as the iron golf club head obtained in Example 1.

What is claimed is:

1. A wood-type golf club head comprising an outer shell consisting of a fiber reinforced thermosetting resin having the shape of a wooden golf club, a metal sole provided on a lower surface of said outer shell, and a core placed on an upper surface of said sole so as to be buried in the interior of said outer shell, said core being molded from a mixture of a thermoplastic resin selected from the group consisting of polyamide, polybutylene terephthalate, polypropylene, ABS and hard vinyl chloride and a metal powder having a high specific gravity selected from the group consisting of zinc, lead and tungsten.

2. The wood-type golf club head of claim 1, wherein said core contains a fibrous reinforcing material selected form the group consisting of short glass fibers, short carbon fibers and whiskers.

3. The wood-type golf club head of claim 1, wherein the specific gravity of said core mixture is from about 1.5 to 5.0.

4. The wood-type golf club head of claim 3, wherein the surface hardness of said core is 80 to 130 in Rockwell hardness.

* * * * *

UNITED STATES PATENT AND TRADEMARK OFFICE

CERTIFICATE OF CORRECTION

PATENT NO. : 5,009,425

DATED : April 23, 1991

INVENTOR(S) : Takaharu OKUMOTO et al.

It is certified that error appears in the above-identified patent and that said Letters Patent is hereby corrected as shown below:

On the title page, item [75]:

Inventors, line 2, the name "Tstsuya" should be

--Tetsuya--.

Signed and Sealed this

Fifth Day of January, 1993

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,009,425

DATED : April 23, 1991

INVENTOR(S) : Takaharu Okumoto et al.

It is certified that error appears in the above-identified patent and that said Letters Patent is hereby corrected as shown below:

On the title page: Item [75]:

Inventors, line 2, the name "Tstsuya" should be

--Tetsuo--.

This Certificate supersedes Certificate of Correction issued January 5, 1993

Signed and Sealed this

Eighteenth Day of May, 1993

*Attest:*

Michael K. Kirk

MICHAEL K. KIRK

*Attesting Officer*

*Acting Commissioner of Patents and Trademarks*